US005584529A

United States Patent [19]

Cheng

[11] Patent Number: 5,584,529

[45] Date of Patent: Dec. 17, 1996

[54] FOLDING CHAIR

[76] Inventor: Chin-chang Cheng, No. 20, Lane 327, Sec. 2, Chung Shan Rd., Chung Ho City, Taipei Hsien, Taiwan

[21] Appl. No.: 498,644

[22] Filed: Jul. 6, 1995

[51] Int. Cl.[6] ..... A47C 4/24

[52] U.S. Cl. ..... 297/38; 297/41; 297/59

[58] Field of Search ..... 297/16.1, 38, 40, 297/41, 59, 60

[56] References Cited

U.S. PATENT DOCUMENTS

| | | | |
|---|---|---|---|
| 169,748 | 11/1875 | Wakefield | 297/60 X |
| 181,143 | 8/1876 | Cogger | 297/38 |
| 797,841 | 8/1905 | Conn | 29/408 |
| 1,916,772 | 7/1933 | Pratt | 297/41 X |
| 2,009,918 | 7/1935 | Grassi | 397/38 X |
| 2,996,331 | 8/1961 | Clarin | 297/38 |

*Primary Examiner*—Peter R. Brown

*Attorney, Agent, or Firm*—Abelman, Frayne & Schwab

[57] ABSTRACT

A folding chair includes a pair of posts, a pair of foldable armrests having one end slideably and pivotably connected to the posts, a seat having one end pivotably connected to the posts and another end pivotably connected to the armrests, and a pair of two supporting rods arranged in a cross manner and pivotably connected to each other having two upper ends respectively pivotably connected to one of the posts and the seat via a supporting lever and two lower ends with one end extending toward one of the posts and fixedly connected therewith and the other end extending away therefrom.

7 Claims, 3 Drawing Sheets

FOLDING CHAIR

FIELD OF THE INVENTION

The present invention is related to a chair, particularly to a folding chair which can be folded to facilitate transportation and storage thereof and have a stronger structure than conventional folding chairs.

BACKGROUND OF THE INVENTION

Common unfoldable chairs have the advantage that they have a strong structure to withstand a heavy load. However, they have the disadvantage that they cannot be folded so that they must occupy a fixed space, which is inconvenient for storage or transportation. Alternatively, although there have been many types of folding chair which have been sold in the market, these conventional folding chairs have a relatively weak structure so that after a period of use they may lose their original rigidity and firmness.

SUMMARY OF THE INVENTION

It is an objective of the present invention to provide a folding chair having a novel arrangement.

A further objective of the present invention is to provide a folding chair having a stronger structure than conventional ones.

It is a further objective of the present invention to provide a folding chair having an armrest which is also foldable and will occupy only a small space when the chair is folded.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
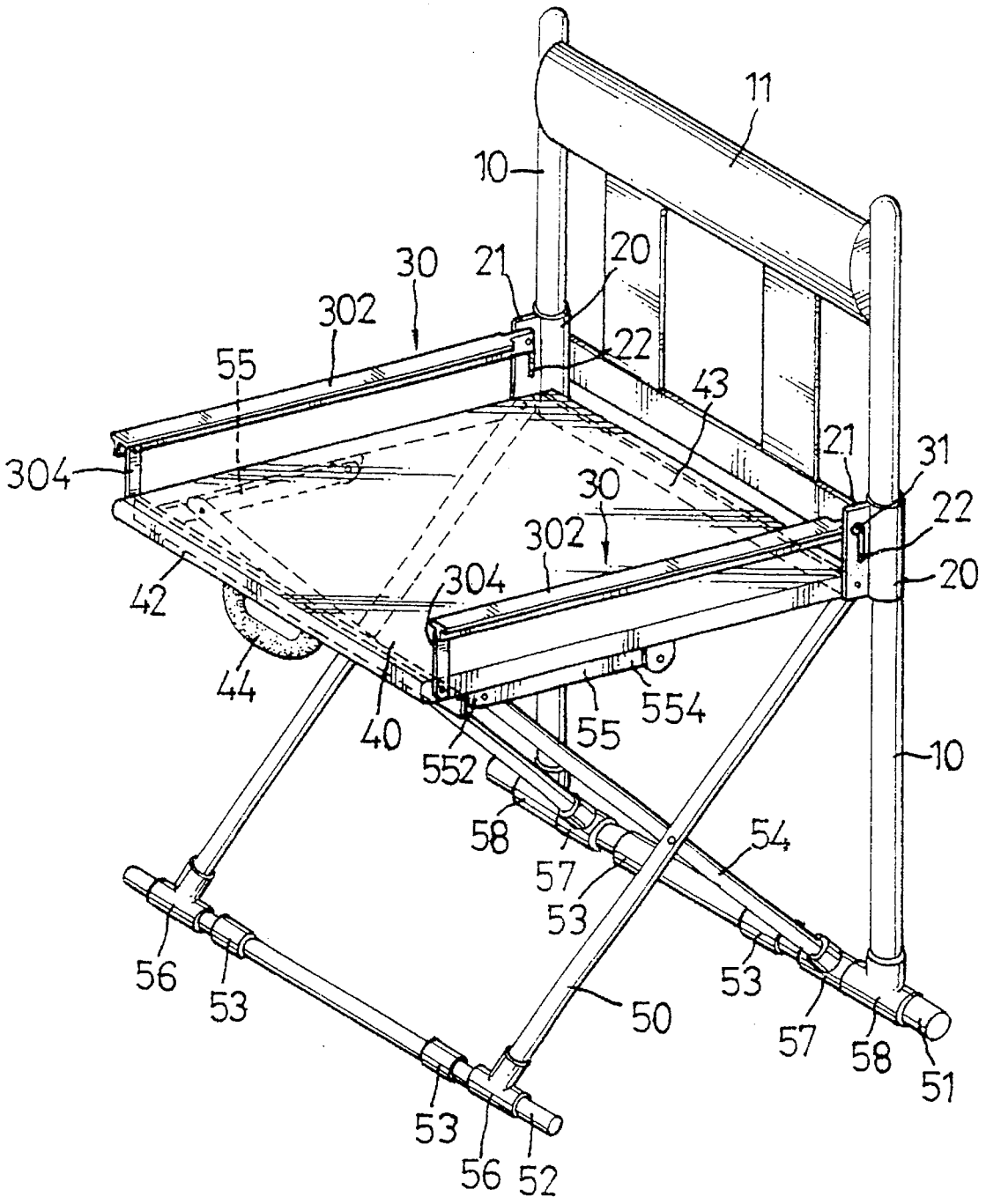
FIG. 1 is a front-right-top perspective view of a folding chair in accordance with the present invention, showing that the chair is fully extended for a normal use.
Figure 2:
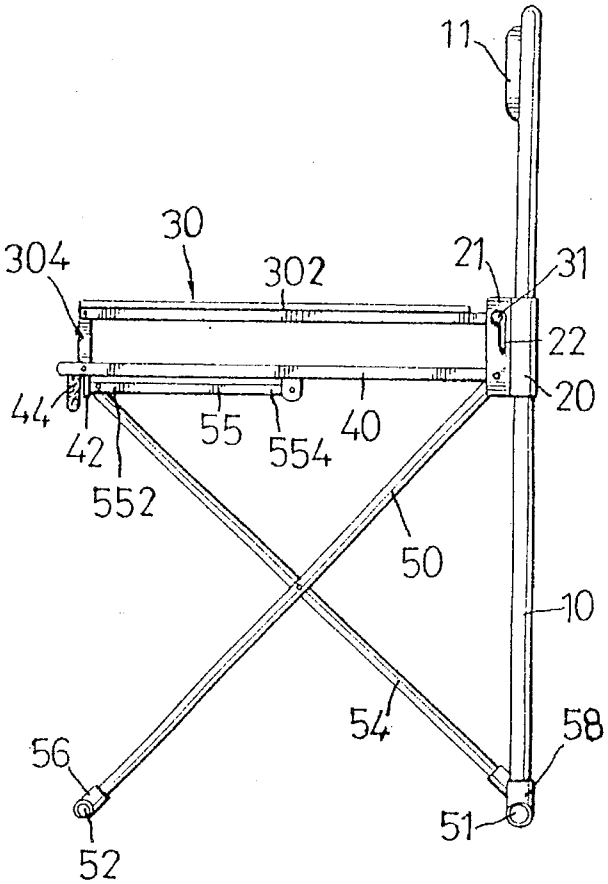
FIG. 2 is a right side view of FIG. 1.

Refer to FIGS. 1 and 2, which respectively are perspective and side views showing that the present folding chair is fully extended for a normal use. The present folding chair is consisted of a pair of upright posts 10 which form a relatively fixed frame portion of the present chair, a seat back 11 generally fixedly attached to the posts 10, a pair of foldable armrests 30 pivotably and slideably connected to a pair of guiding plates 21 fixedly attached to the posts 10, a seat 40 pivotably connected to the guiding plates 21 and the armrests 30, a pair of crossly arranged and pivotably connected rods 50 and 54 having upper ends respectively pivotably connected to the seat 40 via a pair of supporting levers 55 and the posts 10 wherein the rods 50 and 54 form a relatively foldable frame portion of the present chair, a rear leg portion 51 (i.e., directly below the seat back 11) fixedly connected to the posts 10 via T-shaped connectors 58 and the rods 54 via T-shaped connectors 57, and a front leg portion 52 fixedly connected to the rods 50 via T-shaped connectors 56.

The posts 10 include a pair of sleeves 20 respectively fixedly fastened thereto and having the guiding plates 21 integrally formed therewith. Each of the guiding plates 21 has a guiding slot 22 defined therein and substantially shaped as an inverted L.

Each of the armrests 30 includes an arm resting portion 302 having a rear end with a pin 31 received in the slot 22 and a connecting portion 304 pivotably connected between the arm resting portion 302 and the seat 40.

Each of the supporting levers 55 has a rear end 554 pivotably connected with the seat 40 and a front end 552 pivotably connected with a front end of the rod 54. The supporting levers 55 constitute a side support for the seat 40 to support the load acting on the seat 40 when, for example, a person is seated on the chair, thereby to enhance the rigidity and firmness of the present chair.

The seat 40 further includes front and rear reinforcing plates 42 and 43 and a handle 44 which is used to facilitate the folding of the present chair.

Four pads 53 are provided on the front and rear leg portions 51 and 52 to protect the leg portions 51 and 52.

Figure 3:
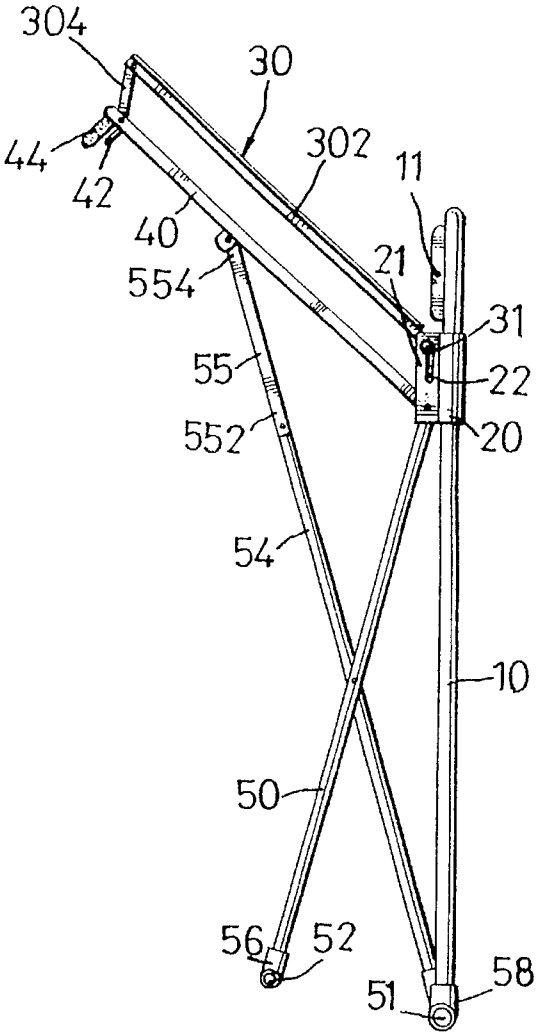
FIG. 3 is a view similar to FIG. 2, but showing that the chair is partly folded.
Figure 5:
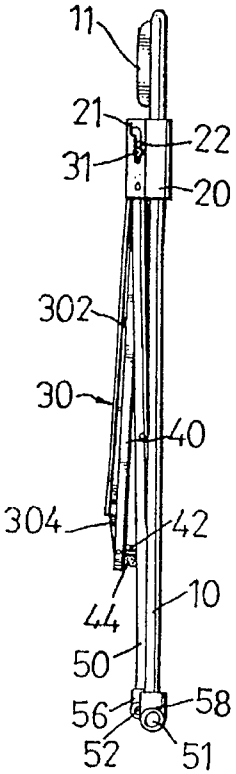
FIG. 5 is a view similar to FIG. 4, but showing that the chair is further folded therefrom to have a fully folded configuration.
Figure 4:
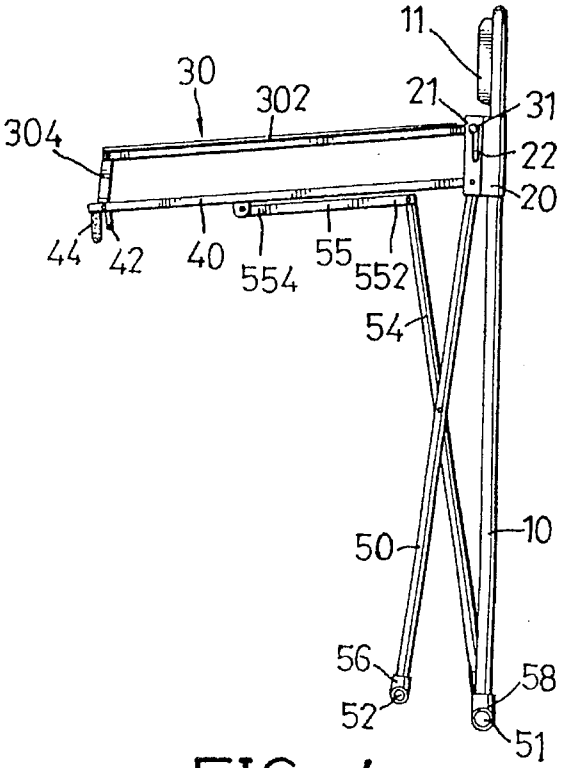
FIG. 4 is a view similar to FIG. 3, but showing that the chair is further folded therefrom.

Now turning to FIGS. 3 through 5, when the present chair is intended to be folded, as shown in FIG. 3, firstly the front ends of the seat 40 and the armrests 30 are pulled upwardly by pulling the handle 44 to cause the seat 40 and the armrests 30 to pivot about the guiding plates 21 and the supporting levers 55 align with the rods 54, in which the front end 552 of the levers 55 is now located between the rear end 554 thereof and the rods 54.

Then, the front ends of the seat 40 and the armrests 30 are pushed downwardly while the front end 552 of the supporting lever 55 is pushed toward the posts 10 to cause the supporting lever 55 to pivot counterclockwise to reach a position just below and neighboring the seat 40, in which the front end 552 of the supporting lever 55 is now located behind the rear end 554, as shown in FIG. 4.

Then, the seat 40 and the armrests 30 are continued to be pushed downward to have a fully folded configuration as show in FIG. 5, in which the pins 31 on the rear ends of the armrests 30 are released from horizontal portions of the inverted L-shaped slot 22 and slid downwardly along the vertical portion thereof to reach the lowest ends of the slots 22.

Figure 6:
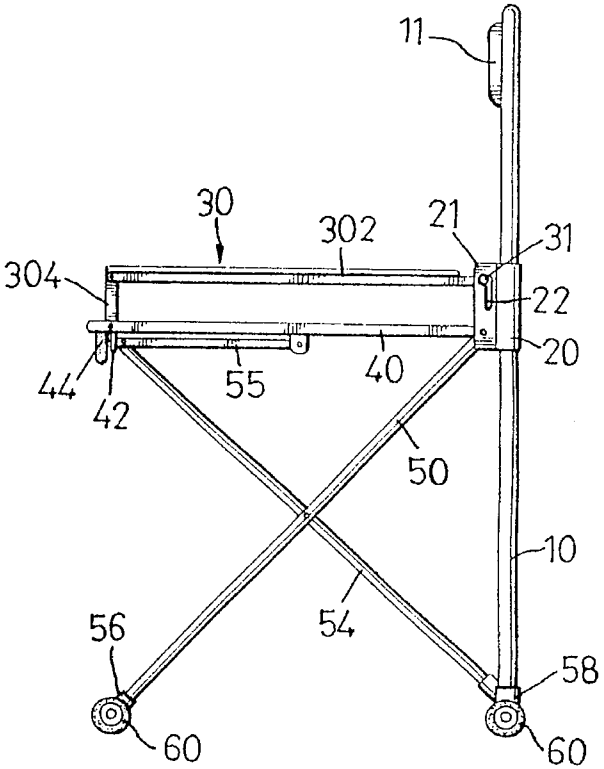
FIG. 6 is a view similar to FIG. 2, but showing a modified embodiment of the present folding chair.

FIG. 6 showing an alternative embodiment of the present chair where four wheels 60 are attached to the leg portions 51 and 52 to enhance the mobility of the present chair.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A folding chair, comprising:

a pair of upright posts;

a seat back fixedly mounted on the upright posts;

a seat pivotably connected to the upright posts;

a pair of foldable armrests with one end pivotably and slideably connected to the upright posts and another end pivotably connected to the seat;

a pair of supporting levers located below the seat and pivotably connected thereto; and a pair of two supporting rods arranged in a cross manner and pivotably connected with each other, each pair having two upper ends respectively pivotably connected to one of the posts and the levers and two lower ends with one end extending toward one of the posts and fixedly connected therewith and the other end extending away from one of the posts.

2. A folding chair according to claim 1, wherein each of the upright posts comprises a means forming a guiding path substantially shaped as an inverted L and wherein the end of the armrests pivotably and slideably connected to the posts is received in the guiding path.

3. A folding chair according to claim 2, wherein each of the armrests comprises an arm resting portion defining the end pivotably and slideably connected to the posts and a connecting portion pivotably connecting the arm resting portion and the seat.

4. A folding chair according to claim 2, wherein the guiding path is a slot formed in plates fixedly attached to the posts.

5. A folding chair according to claim 1, wherein the seat further comprises a handle.

6. A folding chair according to claim 1 further comprising a first plurality of T-shaped connectors connected with the posts and the lower ends of the supporting rods extending toward the posts and a leg member passing through the first plurality of T-shaped connectors to function as a rear leg of the chair, and a second plurality of T-shaped connectors connected with the lower ends of the supporting rods extending away from the posts and another leg member passing through the second plurality of T-shaped connectors to function as a front leg of the chair.

7. A folding chair according to claim 6, further comprising a plurality of wheels provided on the two leg members to enhance the mobility of the chair.

* * * * *